US010125534B2

(12) United States Patent
Bruderer et al.

(10) Patent No.: US 10,125,534 B2
(45) Date of Patent: Nov. 13, 2018

(54) METHOD FOR PRODUCING BLOCKS OF WINDOWS

(71) Applicant: NOLAX AG, Sempach Station (CH)

(72) Inventors: Beat Bruderer, Zürich (CH); Patrick Steiner, Schattdorf (CH); Anton Brandmair, Nottwil (CH)

(73) Assignee: NOLAX AG, Sempach Station (CH)

( * ) Notice: Subject to any disclaimer, the term of this patent is extended or adjusted under 35 U.S.C. 154(b) by 0 days.

(21) Appl. No.: 15/560,610

(22) PCT Filed: Mar. 7, 2016

(86) PCT No.: PCT/EP2016/054800
§ 371 (c)(1),
(2) Date: Sep. 22, 2017

(87) PCT Pub. No.: WO2016/162154
PCT Pub. Date: Oct. 13, 2016

(65) Prior Publication Data

US 2018/0094474 A1 Apr. 5, 2018

(30) Foreign Application Priority Data

Apr. 8, 2015 (EP) ..... 15162815

(51) Int. Cl.
*E06B 3/54* (2006.01)
*E06B 3/56* (2006.01)

(52) U.S. Cl.
CPC ..... *E06B 3/5409* (2013.01); *E06B 3/5427* (2013.01); *E06B 3/56* (2013.01)

(58) Field of Classification Search
CPC ..... E06B 3/5409; E06B 3/54; E06B 3/5427; E06B 3/56
See application file for complete search history.

(56) References Cited

U.S. PATENT DOCUMENTS 4,837,993 A * 6/1989 Studenski ..... E06L 33/02 52/208
5,937,611 A * 8/1999 Howes ..... B32B 17/10036 156/99

(Continued)

FOREIGN PATENT DOCUMENTS

DE 195 46 847 A1 6/1997
DE 20 2005 001 073 U1 6/2005

(Continued)

OTHER PUBLICATIONS

International Search Report Corresponding to PCT/EP2016/054800 dated Jun. 22, 2016.

(Continued)

*Primary Examiner* — Paola Agudelo
(74) *Attorney, Agent, or Firm* — Davis & Bujold PLLC; Michael J. Bujold

(57) ABSTRACT

A method for producing blocks of windows (1). The method comprises the following steps: i) providing a frame consisting of frame profiled elements (2) having one or more panes (3) arranged therein, wherein a gap (4) can be formed between at least one frame profiled element (2) and the one or more panes (3), ii) inserting adaptable, particularly temporary, boundaries (7) for bounding the application region into the gap (4), wherein the application region is bounded by the boundaries (7) in the peripheral direction, the frame profiled element (2), and the one or more panes (3), and iii) introducing the curable plastic (6) into the application region.

9 Claims, 2 Drawing Sheets

(56) References Cited

U.S. PATENT DOCUMENTS

Figure 1:
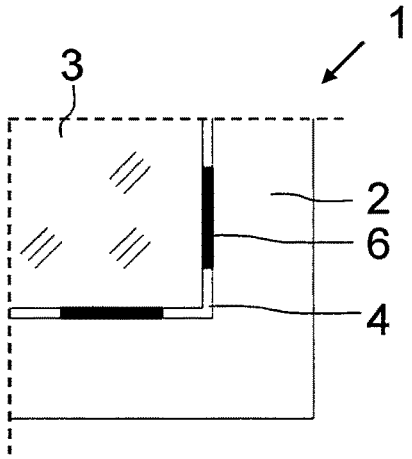

| | | | | |
|---|---|---|---|---|
| 7,712,503 | B2 * | 5/2010 | Spotts | E06B 3/67339 156/107 |
| 2004/0140037 | A1 * | 7/2004 | Kitzmuller | E06B 3/56 156/71 |
| 2006/0135726 | A1 * | 6/2006 | Haas | C08G 18/0876 528/44 |
| 2009/0056246 | A1 * | 3/2009 | Prince | E06B 3/56 52/204.53 |
| 2010/0021676 | A1 * | 1/2010 | Laubry | C08G 18/281 428/63 |
| 2016/0176104 | A1 * | 6/2016 | Buck | E06L 33/54 264/263 |
| 2017/0368764 | A1 * | 12/2017 | Busby | B29C 65/4805 |

FOREIGN PATENT DOCUMENTS

| | | | | |
|---|---|---|---|---|
| DE | 10 2004 017 421 | A1 | 11/2005 | |
| EP | 1 373 672 | B1 | 6/2009 | |
| EP | 2 685 043 | A1 | 1/2014 | |
| EP | 2685043 | A1 * | 1/2014 | E06B 3/5409 |
| NL | 7 304 185 | | 9/1974 | |
| WO | 97/03270 | A1 | 1/1997 | |
| WO | 02/081854 | A1 | 10/2002 | |
| WO | 2010/020280 | A1 | 2/2010 | |

OTHER PUBLICATIONS

Written Opinion Corresponding to PCT/EP2016/054800 dated Jun. 22, 2016.

* cited by examiner

METHOD FOR PRODUCING BLOCKS OF WINDOWS

The invention relates to a method for producing block elements of windows, wherein, in particular, fast-curing plastics form the block element.

In the glazing of insulating windows, casements or glass doors, one or more panes are inserted into a prefabricated frame and fixed there. The panes are mostly amalgamated in a relatively thick and heavy pane packet. The frame consists of frame profiles. In reglazings of frames, but also repair works, plastics blocks are usually inserted between the rim of the pane or pane packet and the frame rabbet of the frame (block element). The blocks fix the panes or the pane packet in a central position. When a window is used as intended, the inserted blocks divert the weight of the panes or pane packets onto the pivot bearing of the window.

Misfitments of block elements regularly lead to pane breakages, since forces and thus tensions within the panes are diverted only insufficiently in an uncontrolled manner. By misfitment of a block element is generally understood the incorrect or inadequate positioning of the blocks. Damage arising from such misfitments of block elements has to be expensively repaired.

Methods for the fitment of block elements in windows are known. DE 195 46 847 A1 describes a method for fixing panes in the rabbet of a frame by inserting these such that the edges are spaced apart, and by the subsequent fitment of block elements with rabbet inlays. Volumes within the inserted rabbet inlays, said volumes being closed on all sides, are filled with a liquid medium, and thus the rabbet inlay, by the application of pressure, is moved in the direction of the edge of the pane until the rabbet inlay is in place.

EP 2 685 043 A1 describes a casement or door leaf consisting of a frame comprising frame profiles and a pane packet inserted in said frame. Into a frame gap between the rim of the pane packet and the rabbet of a frame profile are inserted one or more glazing blocks. At least one of the glazing blocks is configured with open bottom face and top face and has in the inside an adhesive filling, which bonds the rim of the pane packet to the frame rabbet. A drawback with the above-stated methods and windows is that the blocks are difficult to introduce. Furthermore, subsequent filling makes an additional method step necessary.

EP 1 373 672 likewise describes the fitment of block elements in windows. An adhesive layer is present in a gap between rabbet and insulating glazing, wherein, at a distance from the rabbet face, a peripherally running delimiter web for the adhesive layer is provided. The adhesive layer is formed of an elastic adhesive. The introduced adhesive has a tendency to run, and thus a fitment of block elements for the diversion of high weight/forces is not ensured.

It is therefore an object of the invention to overcome the drawbacks of the prior art. In particular, it is an object of the invention to provide a method in which the delimiters for the plastic which is to be introduced are universally adaptable.

For the method for producing block elements of windows, a frame consisting of frame profiles, having one or more panes arranged therein, in particular a pane packet arranged therein, is provided. Between at least one of the frame profiles and the one or more panes a gap can be formed. One or more adaptable, in particular temporary, delimiters are inserted into the gap between the frame profile and the one or more panes in order to delimit the application region. The application region is here delimited by the one or more delimiters in the peripheral direction, the frame profile and the one or more panes. A curable plastic is introduced into the application region. By adaptable delimiters is here and hereinafter understood that the delimiters can be chosen in terms of their dimensions. In this way, a method is provided, wherein the delimiters for the plastic which is to be introduced are universally adaptable, so that the application region for the plastic in the gap, and thus the dimensions of the block, can be chosen according to the situation. Different sizes of blocks thus do not have to be provided in advance. Due to the adaptable delimiters, the introduced plastic does not run in the peripheral direction. By tdelimiter/delimiters in the peripheral direction are understood delimiters which are arranged or arrangeable substantially parallel to the edge(s) of the one or more panes, in particular the pane packet (cf. FIGS. 2 and 3).

The adaptable, in particular temporary, delimiters can be selected from the group air cushions, compriband, foams, Teflon tape, silicone paper, compression delimiters, hoses, expansion seals, non-recoverable delimiter.

The adaptable, in particular temporary, delimiters can delimit the application region in the longitudinal direction with regard to the frame profile and in the peripheral direction with regard to the frame profile. By delimiters in the longitudinal direction are understood delimiters which are arranged or arrangeable substantially transversely, in particular at right angles, to the peripheral direction along the thickness of the one or more panes, in particular the pane packet, in regard to the frame profile (cf. FIGS. 2 and 3). Naturally, if two delimiters are inserted in the longitudinal direction, these can differ in terms of the angle to the peripheral direction of the frame profile. The delimiters in the longitudinal direction can be arranged or arrangeable transversely, in particular at right angles, to that face of the profile on which the one or more panes, in particular the pane packet, rest(s) (cf. FIG. 2). Naturally, if two delimiters are inserted in the longitudinal direction, these can differ in terms of the angle to that face of the profile on which the one or more panes, in particular the pane packet, rest(s). Furthermore, in addition to one or more delimiters in the peripheral direction, one or more delimiters in the longitudinal direction can be arranged/arrangeable transversely, in particular at right angles, to the peripheral direction along the thickness of the one or more panes, in particular the pane packet. In this way, an introduced plastic is held in position and does not run in the longitudinal direction and in the peripheral direction. The method further comprises the curing of the introduced plastic. In this way, the introduced plastic becomes a load-bearing block, which has the known functions and requirements for the window block element. In particular, the plastic of the adaptable, in particular temporary, delimiters is held in position for a while until the plastic is sufficiently cured and thus remains independently in its position.

The application region or the dimensions of the application region depend on the gap size, preferredly within the range from 1 to 5 mm; the thickness of the one or more panes, in particular the pane packet, preferredly within the range from 18 to 60 or 100 mm. The length of the block element can be within the range from 25 to 300 mm, preferredly 50 to 150 mm, particularly preferredly 75 to 125 mm. Optimally, the block element can have a length of 100 mm. The application region can have dimensions within the range from 2 mm×18 mm×50 mm to 9 mm×100 mm×300 mm, preferredly 3 mm×36 mm×100 mm, particularly preferredly 4 mm×40 mm×100 mm. Since the adaptable, in particular temporary, delimiters are adaptable to the dimensions of the gap, an application region having the aforementioned dimensions can be conceived. In this way, a gap having the above-stated dimensions can in some regions be filled with the curable plastic.

The curable plastic can be based on fast-curable polyurea adhesives. Generally these are two-component adhesives comprising an isocyanate-containing component A and an amine-containing component B, wherein component A contains an isocyanate-terminated and component B at least a diamine and/or polyamine and/or polyether polyamine. Adhesive compositions of this type are described in EP 1 958 975 A1 and are herewith incorporated by reference. In this way, the plastic hardens quickly, which enables high cycle rates in the production process. In addition, component A can comprise a monomeric polyisocyanate.

The above-stated plastic based on a fast-curable polyurea adhesive can additionally have a trimerization catalyst, in particular in component B. As trimerization catalysts can be used, in particular, metallic salts of a carbonic acid, preferredly potassium octoate and potassium acetate, phosphines, sodium hydroxide, potassium hydroxide, quaternary ammonium salts, 2,4,6-tris(dimethylaminomethyl)phenol and/or mixtures of catalysts, such as, for instance, Jeffcat TR® (Huntsman).

The curable plastic can be set such that the curable plastic, as it hardens, bonds to the frame profile and/or the one or more panes, in particular the pane packet. This means that the curable plastic bonds either only to the frame profile or only to the one or more panes. Alternatively, the curable plastic can also bond both to the frame profile and to the one or more panes. In this way, a bonding can be realized according to requirement.

In addition, an application device can be provided. By means of the application device, an, in particular fast-curable plastic can be introduced. The plastic is here introduced into the formed gap between frame profile and the one or more panes. By means of the application device, the feed-in operation can be optimally controlled, in particular the application quantity and application position can be realized reproducibly. In this way, misfitments of block elements are minimized.

The application device can comprise the previously described adaptable, in particular temporary, delimiters. As the application device approaches an application site, a gap is formed between frame profile and the one or more panes, and the adaptable, in particular temporary, delimiters are introduced. As previously described, the delimiters define the application region or the dimensions of the application region. In this way, the process flow is accelerated and high cycle rates for the block element fitment process can be achieved.

For the formation of the gap, a clamping, spreading or pushing device can also be used. A device of this type advantageously ensures the formation of the gap between frame profile and the one or more panes. This device can likewise be integrated in the application device. The steps: formation of the gap, insertion of delimiters and introduction of plastic are thus realized in quick succession or almost simultaneously. In this way, the process flow is accelerated and high cycle rates can be achieved for the block element fitment process.

The method can be implemented manually or can be automated. Equally, the method can be partially or semi-automated. Process parameters such as, for instance, positions of the block elements, number of block elements per frame, dimensions of the blocks, feed-in times of the plastic, and cycle rates, can be chosen and executed by means of the automated method on a usage-specific basis. For this, a control unit and appropriate robots can be provided. In this way, the method can be performed with particularly high cycle rates and low risk of error. Misfitments are minimized by the automated method in comparison to the manual insertion of block elements.

A further aspect of the invention relates to the use of an, in particular fast-curable, polyurea adhesive as the plastic in the region of the block element of windows, balcony doors, terrace doors, lift and slide mechanisms, skylights, fixed glazings, facade glazings, facade elements, conservatory glazings, partition walls. The usable polyurea adhesives have already been previously described. In this way, the advantages of these fast-curing adhesives can be utilized for the production of block elements and high cycle rates can be obtained.

A further aspect of the invention relates to an application device for the introduction of an, in particular, fast-curable plastic. The application device comprises adaptable, in particular temporary, delimiters, which delimit the application region. The application device can advantageously be used in one of the above-stated methods. The application device can be fastened directly onto the exit point of the plastic on a mixing element (as an add-on unit) or can be conceived as an integral component part of a mixing element. The application device can consist of a supporting and sealing bar, in the sense of a beam. When it is arranged at the gap, the beam forms a delimiter in the peripheral direction. This prevents the introduced plastic from running in the peripheral direction. At the ends of the beam, further delimiter elements can be arranged, for delimiting of the application region in the longitudinal direction, at an angle of about 90° to the beam. These delimiter elements are introduced into the existing gap between glass and rabbet of the frame profile. These prevent the introduced plastic from running in the longitudinal direction. The delimiters in the longitudinal direction laterally seal off the thus formed cavity, which corresponds to the application region. The delimiters can be variable, and thus adaptable, in height. The beam can delimit and seal off the cavity in the peripheral direction against the surface of the one or more panes, in particular the surface of a pane packet. Following the application, or injection, of the curable plastic, in particular of a plastic as previously described, as well as the curing thereof, the application device with the delimiters can be manually, semi-automatically or automatically released and pulled out of the gap. Alternatively, the above-stated delimiters can be conceived as a permanent formwork, which remain within the application region.

The application device can comprise at least one material supply for the provision of curable plastic or components for a curable plastic. Naturally, a plurality of, in particular two, material supplies can also be provided. In this way, curable plastics can be provided in accordance with the usage and situation.

Figure 2:
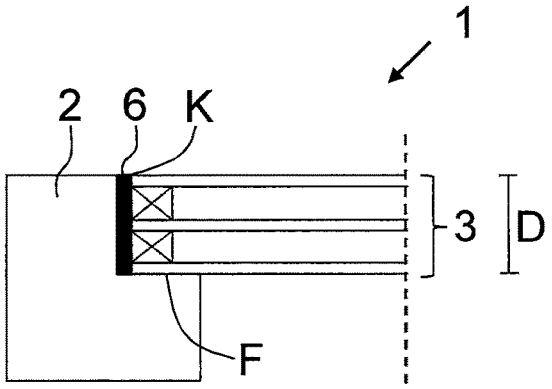
Figure 3:
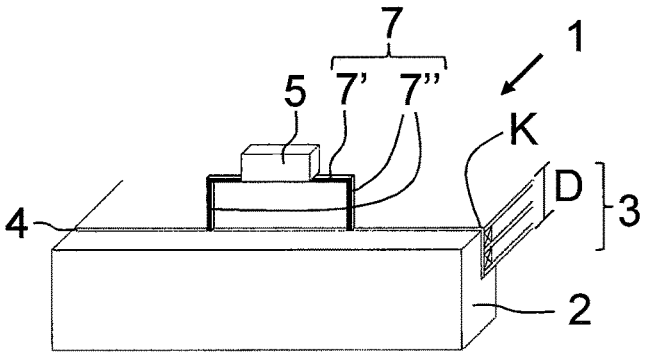
Figure 4:
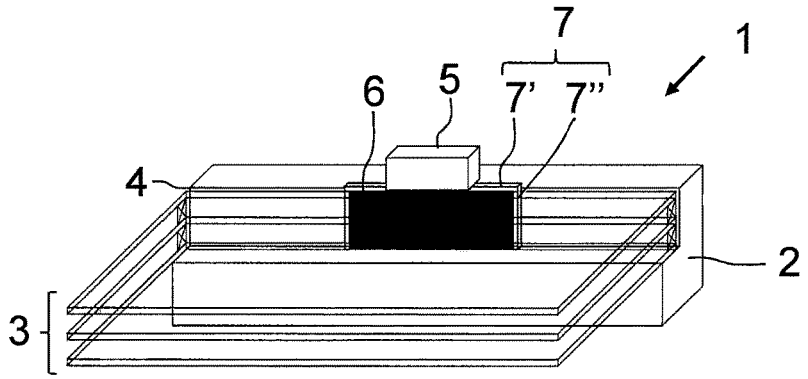
Figure 5A:
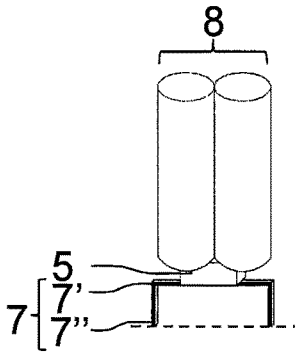
Figure 5B:
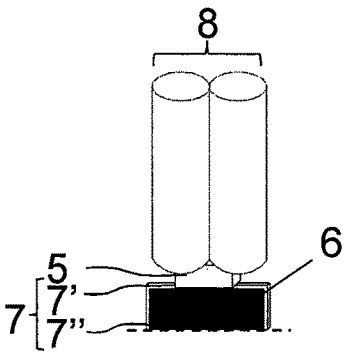
Figure 6:
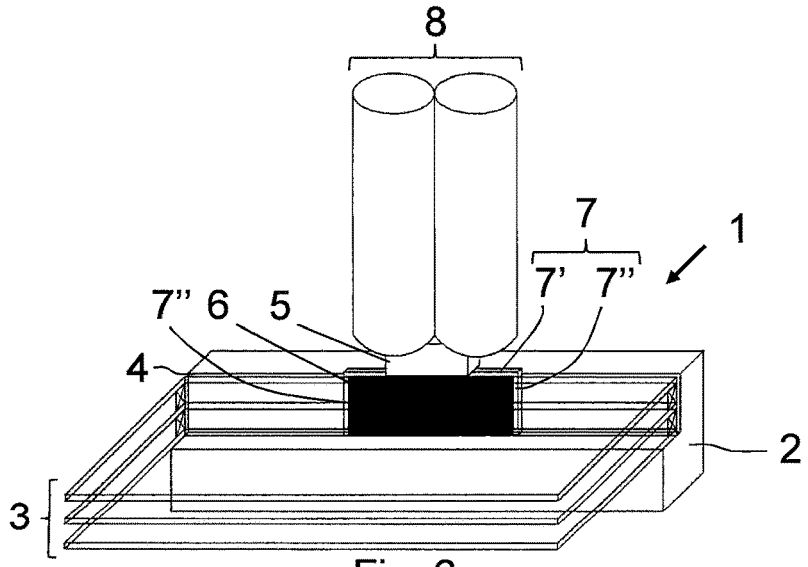

The invention is explained in greater detail below on the basis of diagrams and exemplary illustrative embodiments, wherein:

FIG. 1: shows a side view of a window region with block elements;

FIG. 2: shows a section through a window region with block element;

FIG. 3: shows a perspective view of a frame profile with a first application device according to the invention;

FIG. 4: shows a perspective view of a frame profile with a first application device according to the invention in the gap;

FIG. 5*a*: shows a perspective view of a second embodiment of the application device according to the invention;

FIG. 5*b*: shows a perspective view of a second application device according to the invention with filled application region;

FIG. 6: shows a perspective view of a profile frame with a second application device according to the invention with filled application region.

FIG. 1 shows a side view of a region of a window 1 with block elements. The window 1 comprises a frame profile 2, a pane packet 3, a gap 4, which is present between the frame profile 2 and the pane packet 3, and plastics 6 which have hardened into blocks. In the installed working state of the window 1, the blocks of the cured plastic 6 divert the weight of the pane packet 3 onto the frame profile 2. Through a purposeful diversion of the forces, arising tensions in individual panes of the pane packet 3 are minimized and breakage of glass is prevented.

FIG. 2 shows a section through a region of a window with block element. The pane packet 3 rests on the frame profile 2 on the face F. Between the frame profile 2 and the pane packet 3 is introduced a block of cured plastic 6. Between individual panes of the pane packet 3 are found spacers, which, with the edges K of the panes in the contact region to the block of cured plastic 6, form a contact surface. A thickness D of the pane packet 3 is shown. This contact surface delimits the application region such that the curable plastic 6, when it is introduced, does not make its way between individual panes of the pane packet 3. Thus the frame profile 2 and the contact surface of the pane packet 3 form a lower and an upper delimiter for the curable plastic 6.

FIG. 3 shows a perspective view of a frame profile 2, of a pane packet 3 and of a first application device 5 according to the invention. A thickness D of the pane packet 3 is shown. Between individual panes of the pane packet 3 are found spacers, which form with the edges K of the panes a contact surface. The application device 5 comprises adaptable delimiters 7, which, in the inserted state, define an application region in the gap 4 between the frame profile 2 and the pane packet 3.

The adaptable delimiters 7 comprise the delimiter 7' for delimiting the application region in the peripheral direction of the frame profile 2, as well as the delimiters 7" for delimiting the application region in the longitudinal direction of the frame profile 2. Thus the frame profile 2, the contact surface of the pane packet 3, and the delimiters 7' and 7", in the state inserted in the gap 4, define the application region for a curable plastic (cf. FIG. 4).

FIG. 4 shows a perspective view of a frame profile 2, of a pane packet 3, and of a first application device 5 according to the invention, with delimiters 7 (comprising the delimiters 7' and 7"), wherein the delimiters 7 are inserted in the gap 4. A curable plastic 6 is introduced by means of the application device 5 into an application region, which is defined as previously described for FIG. 3.

FIGS. 5*a* and 5*b* show a second application device 5 according to the invention, which has adaptable delimiters 7 for insertion into a gap 4 (cf. FIGS. 1 to 4). The delimiters 7 comprise the delimiters 7' and 7" for delimiting an application region in the peripheral and longitudinal direction to form a frame profile. The application device 5 comprises a material supply 8, which comprises two or more chambers. Represented are two cylindrical chambers, in which components for a curable plastic can be found. If the delimiters 7 are inserted into a gap for the introduction of a curable plastic (cf. FIGS. 1 to 4), the components can be mixed and introduced into the application region. In contrast to FIG. 5*a*, FIG. 5*b* shows a plastic 6 introduced into the application region. As previously explained, the application region is further delimited (not shown here) by a frame profile and a pane packet.

FIG. 6 shows a perspective view of a frame profile 2, of a pane packet 3 and of a second application device 5 according to the invention (cf. FIGS. 5*a* and 5*b*). The application device 5 has delimiters 7, wherein the delimiters 7 are inserted in the gap 4. The application device 5 additionally comprises a material supply 8, which, for the provision of individual components of the plastic, comprises two or more chambers. Two cylindrical chambers are shown. Naturally, just one or more than two chambers can also be provided. The components of the plastic are mixed, and accordingly a curable plastic 6 is introduced by means of the application device 5 into an application region, which is defined as previously described for FIG. 3. The application region is delimited by the delimiters 7' and 7" in the peripheral and longitudinal direction of the profile frame, and by the contact surface of the pane packet 3 and the frame profile.

The invention claimed is:

1. A method for producing block elements of windows comprising the steps of:

providing a frame comprising frame profiles, having one or more panes arranged therein, wherein a gap is formed between at least one frame profile and said one or more panes, inserting one or more adaptable delimiters into said gap between said frame profile and said one or more panes delimiting an application region, wherein said application region is delimited by said one or more delimiters in a peripheral direction, said frame profile and said one or more panes, and introducing a curable plastic into said application region, and holding the delimeters in position until the plastic is cured, pulling the delimeters out of the gap following the application and curing of the curable plastic, wherein said adaptable delimiters are temporary delimiters, and the cured plastic remains independently in its position.

2. The method according to claim 1, wherein said adaptable delimiters delimit said application region in a longitudinal direction with regard to said frame profile.

3. The method according to claim 1, wherein said application region has dimensions within the range from 2 mm×18 mm×50 mm to 9 mm×100 mm×300 mm.

4. The method according to claim 1, wherein said curable plastic is a fast-curable polyurea base adhesive having a pot life of less than 5 minutes.

5. The method according to claim 4, wherein said curable plastic has a trimerization catalyst.

6. The method according to claim 1, wherein said curable plastic is set such that said curable plastic, as curable plastic hardens, bonds to said frame profile and/or said one or more panes.

7. The method according to claim 1, wherein an application device is provided for introducing the curable plastic.

8. The method according to claim 7, wherein said application device comprises said adaptable delimiters.

9. The method according to claim 1, wherein the method is automated.

* * * * *